United States Patent [19]

Spöler et al.

[11] Patent Number: 4,646,647

[45] Date of Patent: Mar. 3, 1987

[54] SUSPENSION OF RAILS

[75] Inventors: Johannes G. Spöler, Borken; Manfred Grapentin, Herdecke, both of Fed. Rep. of Germany

[73] Assignee: Mannesmann AG, Duesseldorf, Fed. Rep. of Germany

[21] Appl. No.: 542,672

[22] Filed: Oct. 17, 1983

[30] Foreign Application Priority Data

Oct. 29, 1982 [DE] Fed. Rep. of Germany ..... 3240104

[51] Int. Cl.[4] ..... E01B 25/24

[52] U.S. Cl. ..... 104/111; 16/94 R; 248/228; 248/283; 403/4

[58] Field of Search ..... 104/89, 93, 106, 110, 104/111, 91, 95, 107; 16/94 R, 94 D; 248/228, 231.6, 274, 558, 285, 283, 287, 327; 403/4, 387, 408; 238/282, 310, 331

[56] References Cited

U.S. PATENT DOCUMENTS

| | | | |
|---|---|---|---|
| 538,610 | 4/1895 | Hunt | 104/111 |
| 709,816 | 9/1902 | Collins | 248/228 X |
| 1,616,275 | 2/1927 | Olsen | 248/228 X |
| 1,662,539 | 3/1928 | Schmidt | 104/111 |
| 1,779,564 | 10/1930 | Slagel | 248/327 X |
| 3,625,158 | 12/1971 | Lorenz et al. | 104/93 |
| 3,784,097 | 1/1974 | Landis | 238/310 |

FOREIGN PATENT DOCUMENTS

| | | | |
|---|---|---|---|
| 3113786 | 10/1982 | Fed. Rep. of Germany | 104/111 |
| 2387149 | 11/1978 | France | 104/110 |
| 806022 | 12/1958 | United Kingdom | 248/228 |

*Primary Examiner*—Robert B. Reeves
*Assistant Examiner*—David F. Hubbuch
*Attorney, Agent, or Firm*—Ralf H. Siegemund

[57] ABSTRACT

Rails supporting vehicles are suspended under utilization of a mounting plate being laterally adjustable by means of a detent structure and oblong slots secured to a lowermost portion of support tower or the like and having four bores threadedly receiving four suspension bolts for a C-shaped bracket member having an uppermost suspension plate with arc-shaped bores for receiving the suspension bolts; a plurality of nuts threadedly secure the suspension plate to the suspension bolts from above and from below in an elevationally adjustable manner; the rail is secured to the lower portion of the bracket member.

12 Claims, 5 Drawing Figures

Fig. 2
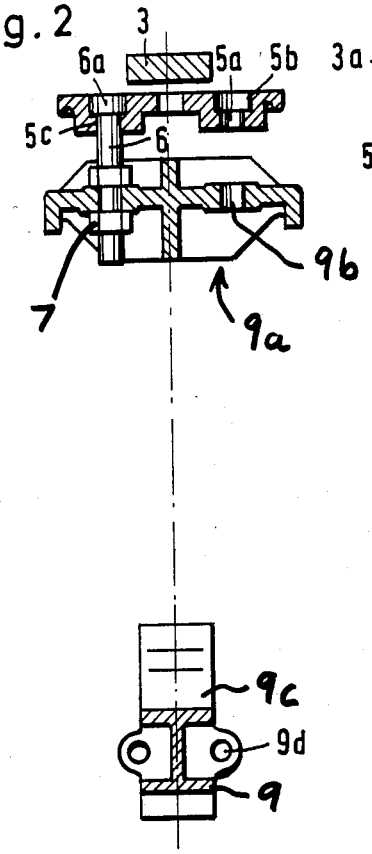
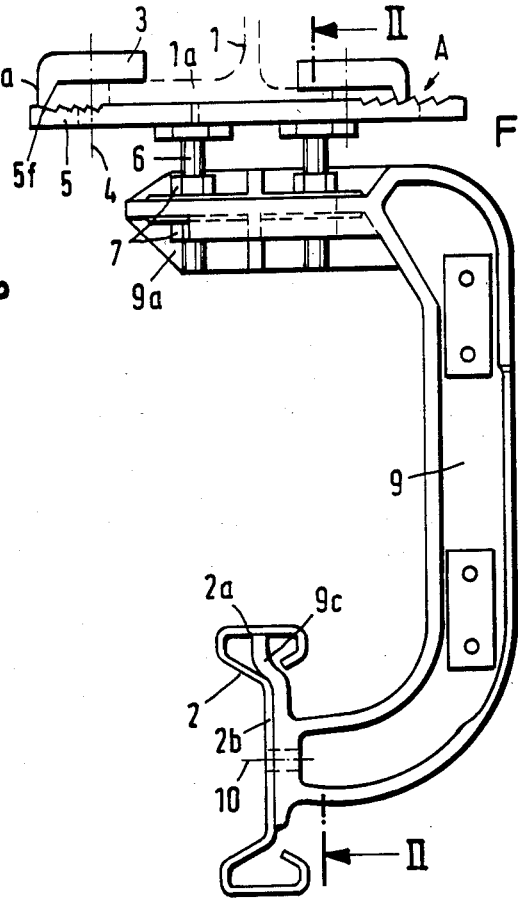
Fig.1
Fig.5
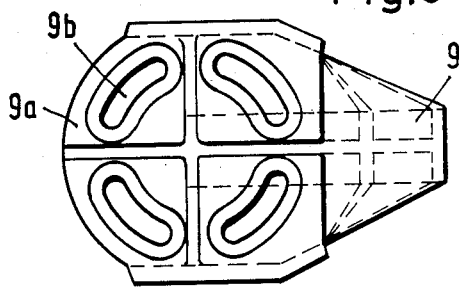
Fig. 3
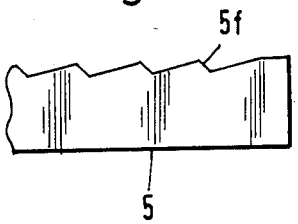
Fig.4
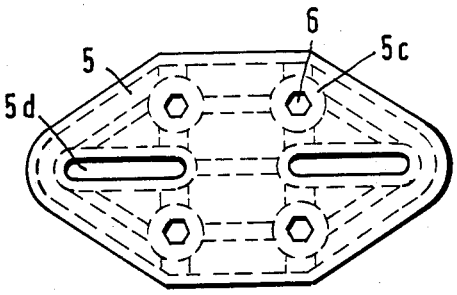

SUSPENSION OF RAILS

BACKGROUND OF THE INVENTION

The present invention relates to the suspension of rails for supporting trolley vehicles or the like and including particular constructions by means of which the rail is suspended from a carrying, support tower or the like.

A suspension for a rail of the type to which the invention pertains is for example disclosed in German printed patent application 1,808,210. The patent application particularly discloses a rigid suspension of the rail so that even vehicles running on the rail and having eccentrically located center of gravity can still be guided on the rail without swinging motion. This particular suspension, however, does not permit vertical level adjustment, for example for orienting the rail or for compensating level and height differences in the principle carrier construction. Such level adjustment is for example disclosed in the U.S. Pat. No. 1,188,659 and includes basically a bolt with an adjusting nut. The latter suspension however permits swinging motion of the rail. Since in that particular example as per the U.S. patent, the load is suspended to be basically below the rail such a swinging motion does not produce any disadvantage. However, the situation is different if the load (vehicle) is basically situated above or even along-side the rail, particularly as far as the location of the center of gravity of the vehicle is concerned. Lateral displacements and lateral swinging motions are not permitted in such a case and therefore the vehicle suspension must compensate against such undesired motion.

DESCRIPTION OF THE INVENTION

It is an object of the present invention to provide a new and improved suspension for rails, the suspension permitting vertical adjustment and is to be provided to accommodate vehicle loads with eccentric center of gravity.

In accordance with the preferred embodiment of the present invention, it is suggested to bolt a plate to the lower end of the principle support construction which plate supports in turn suspension bolts to which a rail supporting bracket can be bolted in vertically adjustable positions; preferably one uses four such suspension bolts so that even in the case of an eccentrical load upon the rail the bracket suspension will remain and will not escape, for example, through bending of any of the bolts. The rail is affixed to the lower end of the bracket which is preferably of a C-shaped configuration. The mounting plate from which the suspension bolts extend, is preferably provided with recesses for receiving the bolt heads. Moreover, this plate is to have at least one, preferably two, transverse slots for receiving bolts by means of which this support plate is laterally displaceably connectable to the basic support construction. This latter feature concerning the mounting is particularly important because it is not possible to determine in advance the exact position of the rail vis-à-vis the principle support system. The variability of a mounting plate in conjunction with clamping brackets engaging teeth on the mounting plate establishes a particular degree of freedom of adjusting the mounting structure in a direction transversely to the general extension of the rail to be mounted. On the other hand, the lateral adjustability of the mounting plate does not interfere at all with the angular and orientational adjustment and positioning of the rail and its immediate support bracket. The aforementioned mounting plate and the clamping brackets cooperate preferably by means of a plurality of detent teeth wherein each tooth is arranged to have a shallow angle towards the center of the system and a steep angle in the opposite direction. The bracket-tooth arrangement prevents an unwanted migration of the clamping brackets as a result of variable dynamic loads on the rail.

In furtherance of the invention four bolts are provided on the mounting plate for purposes of suspending the principle bracket element and they cooperate with a plurality of four arc shaped slots in the suspension plate permitting for example the relative angular displacement of the mounting bracket by not more than about 45°. This arc shaped arrangement of slots permits turning of the principle mounting bracket over a range amounting in effect to 50 percent of all possible positions. This basically is a matter of tolerances and, as an empirical value, was found to be sufficient to accommodate a large variety of possible misalignments inherent in the overall arrangement. Moreover, the particular arrangement and the constructural features permit a high degree of adaptability of the system to a variety of basic support construction. The mounting bracket for the rail has a profile which can be termed as I shaped, particularly in the basic part of its configuration. The bracket has a cross-shaped contour in the range of the suspension by means of the aforementioned suspending bolts whereby particularly the cross is established through flat suspension plate that receives the suspending bolts and a pair of upwardly and downwardly extending bars are provided so as to establish the cross. Essential here is that the arcuate slots are not interrupted. This means that the particular plate is not weakened by fairly long arcuate slots. The principle bracket has an overall C shaped configuration as was mentioned above, whereby the particular rail to be suspended is affixed to the lowermost point of the C while the upper part of the C is configured as the mounting part of cross-shaped configuration by means of which this mounting bracket is suspended through the bolts from the mounting plate mentioned above.

DESCRIPTION OF THE DRAWINGS

While the specification concludes with claims particularly pointing out and distinctly claiming the subject matter which is regarded as the invention, it is believed that the invention, the objects and features of the invention and other objects, features and advantages thereof will be better understood from the following description taken in connection with the accompanying drawings in which:

FIG. 1 is a side elevation of a suspension construction in accordance with the preferred embodiment of the present invention for practicing the best mode thereof;

FIG. 2 is a cross section taken through plane II—II in FIG. 1;

FIG. 3 illustrates a portion of FIG. 1 identified therein by A and illustrated in a larger scale;

FIG. 4 is an elevation of a plate used within and as part of the suspension construction shown in FIGS. 1 and 2; and FIG. 5 is a support plate within the same construction.

DETAILED DESCRIPTION OF THE DRAWINGS

FIG. 1 illustrates the lower cord 1*a* or construction part of a carrying and support construction 1 of general design. A mounting plate 5 (see also FIG. 4) is secured to this lower portion 1*a* of carrier construction 1 by means of four bolts 4 which also traverse clamping jaws 3 situated on top of this lower construction part 1*a*. These jaws 3 are provided with lower end legs 3*a* which bear upon upwardly directed teeth 5*f* of the mounting plate 5. FIG. 3 illustrates the particular tooth construction in an enlarged scale. The teeth have shallow portions or flanks facing towards the center and steep flanks that face outwardly.

The mounting plate 5 is provided with four threaded bores 5*a* there being recesses 5*b* for receiving the heads 6*a* of bolts 6. The recesses 5*b* are actually provided immediately for guide rings 5*c*, which support directly the heads 6*a*. FIG. 4 illustrates further two transverse slots 5*d* which are traversed by the bolts 4 for purposes of adjusting the lateral position of the jaws 3 in the length direction of extension of these slots 5*d*. Jaws and teeth establish an adjustable detent arrangement that prevents migration of plate 5 under variable load. FIG. 1 illustrates particularly, that this lower end portion 1*a* of the support construction 1 may have different lateral extensions so that the adjustability of the relative disposition of the jaws 3 through appropriate configuration of this mounting plate 5 is an important feature.

An upper end suspension plate 9*a* of bracket element 9 is provided with circular arc shaped slots 9*d* for being traversed by the suspension bolts 6 which extend from below the mounting plate 5. Nuts 7 can be threaded on the bolts 6 to fasten the suspension plate 9*a* to the bolts from above as well as from below. Thus, there is a four point suspension with double nuts preventing any vertical displacement. The slots 9*b* have an arc length of 45° and therefore permit rotational adjustment of the bracket 9 about the common center of these four arc slots. This, of course, requires loosening of nuts 7. The bracket 9 with support and suspension plate 9*a* is therefore adjustably positionable in relation to the plate 5. As was outlined above, the lateral slots 5*d* permit lateral adjustment of the position of the mounting plate 5 vis-à-vis the support and carrier construction 1. Plate 9*a* has a cross-like configuration in a three dimensional pattern.

It can readily be seen that in addition to the lateral displacement and the angular displacement of the bracket 9 it is also height adjustable due to the length of the threaded bolts 6 because the carrier plate 9*a* can be fastened by means of the nuts 7 to the suspending bolts 6 in a variety of levels.

The bracket element 9 supports at its lower end a rail 2. In view of the adjustment as described in the preceding paragraphs, the rail 2 can be laterally shifted, lowered and raised as well as pivoted over a range of amounting to a total of 45°. Bracket element 9 has a carrier plate 9*c* of crimped configuration and receives the rail 2 in the illustrated orientation and disposition. The upper crimped end portion of plate 9*c* bears centrally from below against the upper portion 2*a* of the rail, and the central web 2*b* of the rail bears centrally against the flat part of plate 9*c* whereby laterally displaced aperture-holes 9*d* receive fastener bolts by means of which the rail 2 is fastened to and urged against the carrier plate 9*c*.

Further features are to be seen in that the cross-section through the bracket element 9 has an I shaped configuration while the bracket element in the range of the upper, suspension plate 9*a* is a cross-like cross-sectional configuration as stated. This multiple cross-contour is chosen so that the arcuate slots 9*b* are not interrupted. The bracket element 9 as a whole has the configuration of a C and the bores 9*d* are laterally displaced from the plane of the C. The bracket element 9, the plate 5 and the clamping bracket 3 are preferably all made of cast iron.

The invention is not limited to the embodiments described above, but all changes and modifications thereof, not constituting departures from the spirit and scope of the invention, are intended to be included.

We claim:

1. Suspension of a rail for the support of vehicles, there being a basic support and construction facility having a lowermost portion, comprising the combination of:

a mounting plate laterally adjustably and rigidly secured to said lowermost portion and having a plurality of bores respectively threadedly receiving a plurality of suspension bolts; and a bracket member having an uppermost suspension plate being provided with circular-arc-shaped segment slots for receiving said suspension bolts to permit angular adjustment of the bracket member and angular adjustment of the rail accordingly, there being a plurality of nuts for threadedly securing the suspension plate to the suspension bolts from above and from below in an elevationally adjustable manner, said rail being secured to the lower portion of said bracket member.

2. Suspension as in claim 1, said mounting plate being provided with recesses for the receipt of heads of the suspension bolts.

3. Suspension as in claim 1, wherein said mounting plate is provided with at least one transverse slot for mounting the mounting plate to the basic support construction in a laterally adjustable fashion, and by bolt means.

4. Suspension as in claim 3 and including in addition mounting bracket means traversed by the bolt means and provided for positively positioning the mounting plate in relation to the basic support to prevent lateral displacement thereof.

5. Suspension as in claim 4, wherein said mounting plate includes detent teeth engaged by said mounting bracket means.

6. Suspension as in claim 5, wherein the teeth are configured to have a shallow configuration towards the center of the suspension facility and a steep portion in the direction opposite thereto.

7. Suspension as in claim 4, wherein the bracket means, the bracket member, as well as the mounting plate are made of cast iron.

8. Suspension as in claim 1, said arc-shaped slots covering about 45° each.

9. Suspension as in claim 1, there being four suspension bolts.

10. Suspension as in claim 1, wherein said bracket member has an I-shaped profile generally and additionally a cross-shaped profile portion in the vicinity of the suspension plate.

11. Suspension as in claim 1, wherein the bracket member has an overall C-shaped configuration carrying at its lower end a plate which is at least partially inserted into the rail it supports, there being laterally displaced bores in the rail and in the latter plate for bolting the rail to the bracket member.

12. Suspension as in claim 11, wherein the bores of the rail are provided in a web portion of the rail.

* * * * *